US005862849A

United States Patent [19]

Lee

[11] Patent Number: 5,862,849

[45] Date of Patent: Jan. 26, 1999

[54] SUNSHADE ANTI-THEFT WINDOW

[76] Inventor: Ching Huang Lee, 1Fl., No. 44, Lane 144, Sec. 2, Nan Ya South Rd., Taipei, Taiwan

[21] Appl. No.: 64,656

[22] Filed: Apr. 29, 1998

[51] Int. Cl.[6] ..... E04F 10/02; E06B 3/38; E06B 3/68

[52] U.S. Cl. ..... 160/66; 49/50; 49/67; 49/395; 52/106; 160/22; 160/55; 160/72

[58] Field of Search ..... 160/66, 77, 22, 160/55, 72; 49/67, 395, 394, 50, 61, 63; 52/106

[56] References Cited

U.S. PATENT DOCUMENTS

| | | | |
|---|---|---|---|
| 1,332,162 | 2/1920 | Damon | 160/72 |
| 1,751,750 | 3/1930 | Newkirk | 160/72 X |
| 1,777,739 | 10/1930 | Shaw | 160/72 X |

FOREIGN PATENT DOCUMENTS

| | | | |
|---|---|---|---|
| 28087 | 9/1924 | France | 49/67 |

*Primary Examiner*—Robert Canfield

*Attorney, Agent, or Firm*—Pro-Techtor International Services

[57] ABSTRACT

This invention relates to a sunshade anti-theft window which is composed of an anti-theft window and a rolling curtain; wherein the anti-theft window having a pivot arm installed at its bottom, the pivot arm being pivoted on bottom of window-still. The rolling curtain is installed on top of the window-still and have a rolling shaft and a sunshade curtain winded on the rolling shaft, the end of sunshade curtain being connected with top of the anti-theft window. The anti-theft window can be pushed outwardly and rotated around the pivot arm, meanwhile, the sunshade curtain will he dragged openly by the anti-theft window for shading sunlight, furthermore, the sunshade curtain can be returned to original position by means of a tension spring installed on the rolling curtain when the anti-theft is dragged inwardly.

4 Claims, 3 Drawing Sheets

SUNSHADE ANTI-THEFT WINDOW

BACKGROUND OF THE INVENTION (1) Field of this Invention

This invention relates to a sunshade anti-theft window. especially an anti-theft window having a rolling curtain, furthermore, the rolling curtain can be dragged openly and automatically when the anti-theft window is pushed outwardly to a setting angle.

(2) Description of the Prior Art

The conventional anti-theft window is used for preventing theft intruding into from the window; thus the anti-theft window must be made of iron, stainless steel or other rigid metal. But the conventional anti-theft window have a dull appearance, furthermore, we cannot install sunshade curtain on the anti-theft window for shading sunlight, if we install reluctantly a sunshade curtain at outside of the anti-theft window, the user could not open the sunshade curtain easily owing to the separation of anti-theft window.

SUMMARY OF THE INVENTION

It is therefore the main object of this invention to provide a sunshade anti-theft window, the rolling curtain is connected with top of anti-theft window. Furthermore, the anti-theft window can be pushed outwardly from its top to drag the rolling curtain openly for shading sunlight.

It is another object of this invention to provide a sunshade anti-theft window which can be operated easily indoors to open or close the sunshade curtain.

BRIEF DESCRIPTION OF THE DRAWINGS

In the drawings, which illustrate the preferred embodiments and modes of operation of the invention and in which like reference characters designate the same or similar parts throughout the several views.

DETAILED DESCRIPTION OF THE PREFERRED EMBODIMENT

Figure 1:
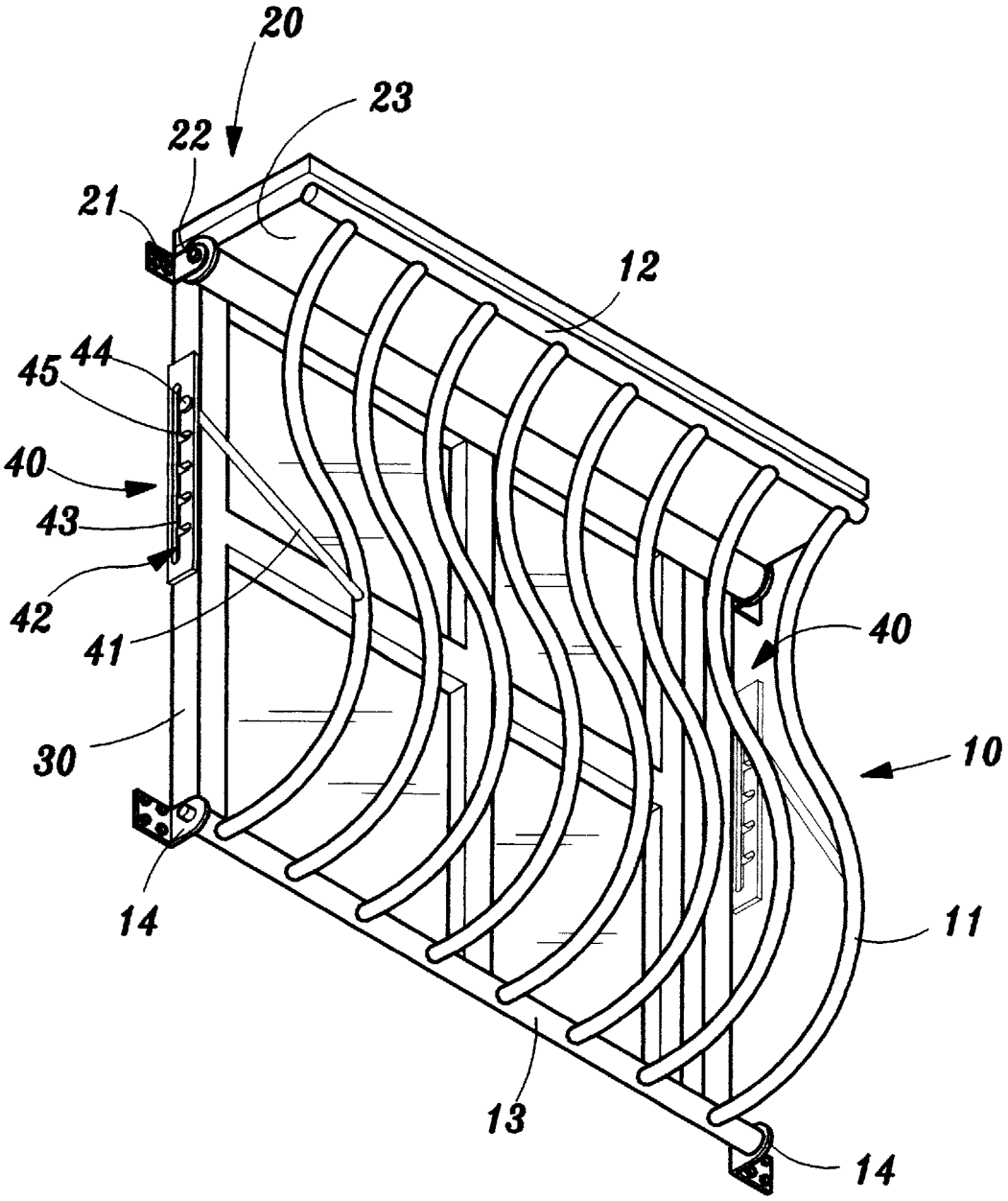
FIG. 1 is a perspective view showing a sunshade anti-theft window of my present invention.

Referring to FIG. 1 to FIG. 4, the present invention a sunshade anti-theft window, is composed of an anti-theft window 10 and a rolling curtain 20. The top of this anti-theft window 10 is connected with the rolling curtain 20, as we push the anti-theft window 10 outwardly, the rolling curtain 20 can he dragged openly for shading sunshine.

The anti-theft window 10 is composed of a plurality of partition rods 11, the top of these partition rods 11 being welded with a cross rod 12 and the bottom welded with a pivoted arm 13, two ends of the pivot arm 13 being pivoted respectively on a pivoting seat 14, furthermore, the pivoting seats 14 being fixed on bottom of window-sill 30.

The top of anti-theft window 10 is not fixed on window-sill, such that, the anti-theft window 10 can be pushed outwardly from its top. At two sides of the window-sill 30 have respectively a locating scat 40 for controlling the open angle of this anti-theft window 10. Each locating seat 40 is composed of a control rod 41 and a guide rail 42. The guide rail 42 have a guide groove 43 in which having a plurality of equidistant locating holes 45, furthermore, one end of the control rod 41 being pivoted on the side of the anti-theft window 10 and the other end being inserted into the guide groove 43 and can be sledded in it freely.

The inserting end of the control rod 41 have a flange 44, diameter of the flange 44 being bigger than width of the guide groove 43, such that, the control rod 41 can slide in the guide groove 43 but apart from the guide groove 43.

As the control rods 41 sledded in the guide groove 43, the anti-theft window 10 can be pushed outwardly and rotated around the pivot arm 13 to change its open angle, such that, the anti-theft window 10 can be located at different open angle by changing the locating position of the control rods 41 in the locating holes 45.

Figure 2:
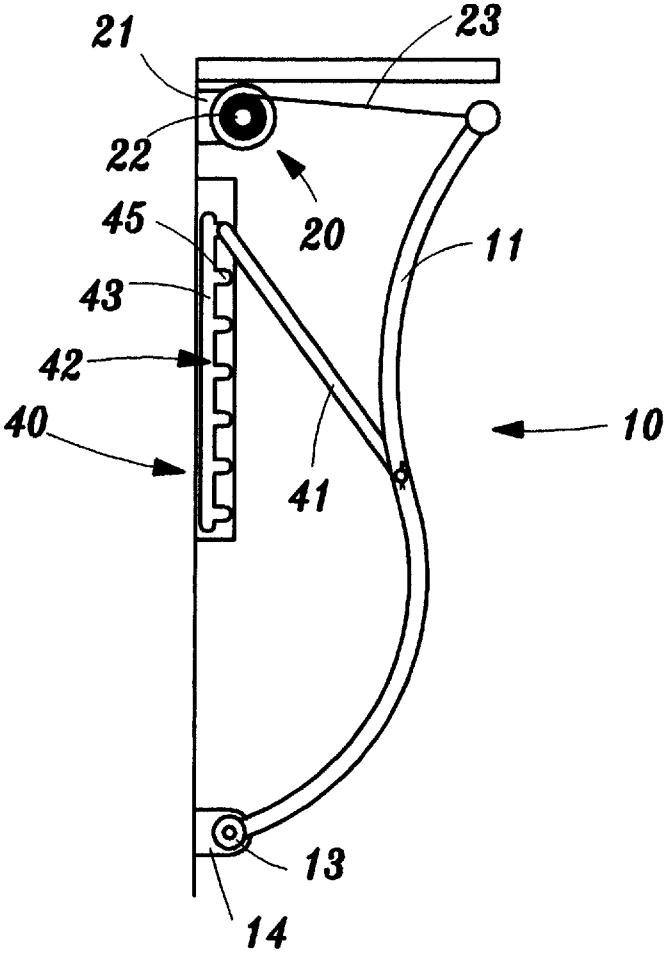

Referring to FIG. 1 and FIG. 2, the rolling curtain 20 is composed of a pair of fixing seats 21 fixed on top end of the window-sill 30, a rolling shaft 22 installed on the fixing seats 21 and call be rotated freely and a sunshade curtain 23 winded on the rolling shaft 22, end of the sunshade curtain 23 being connected with top of the anti-theft window 10. In addition, the fixing seats 21 have respectively a tension spring (not shown in the figures) for returning the sunshade curtain 23 when dragging the anti-theft window 10 inwardly.

Figure 3:
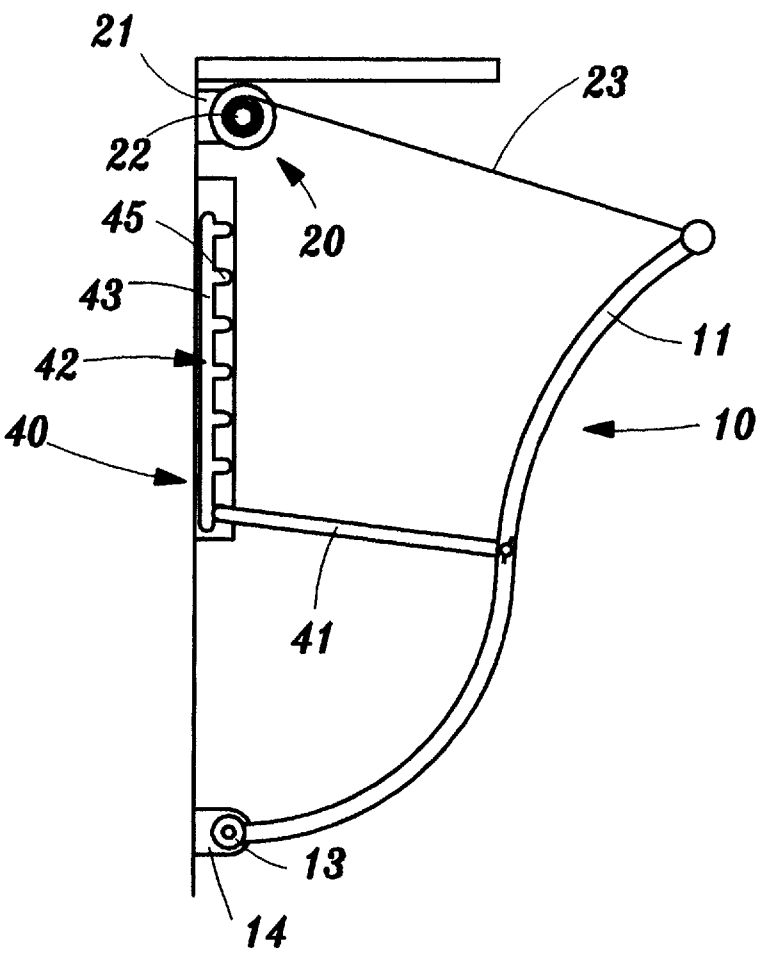
FIG. 2 and FIG. 3 are partial sectional views showing the operation process of this invention.

The FIG. 2 and FIG. 3 shows the operation process of the sunshade anti-theft window 10, the sunshade curtain 23 can be dragged openly for shading sunshine when the anti-theft window 10 is pushed outwardly, because the end of the sunshade curtain 23 being connected with the anti-theft window 10, on the other hand, the sunshade curtain 23 can be return to original position by the tension spring when the anti-theft window is dragged inwardly.

Figure 4:
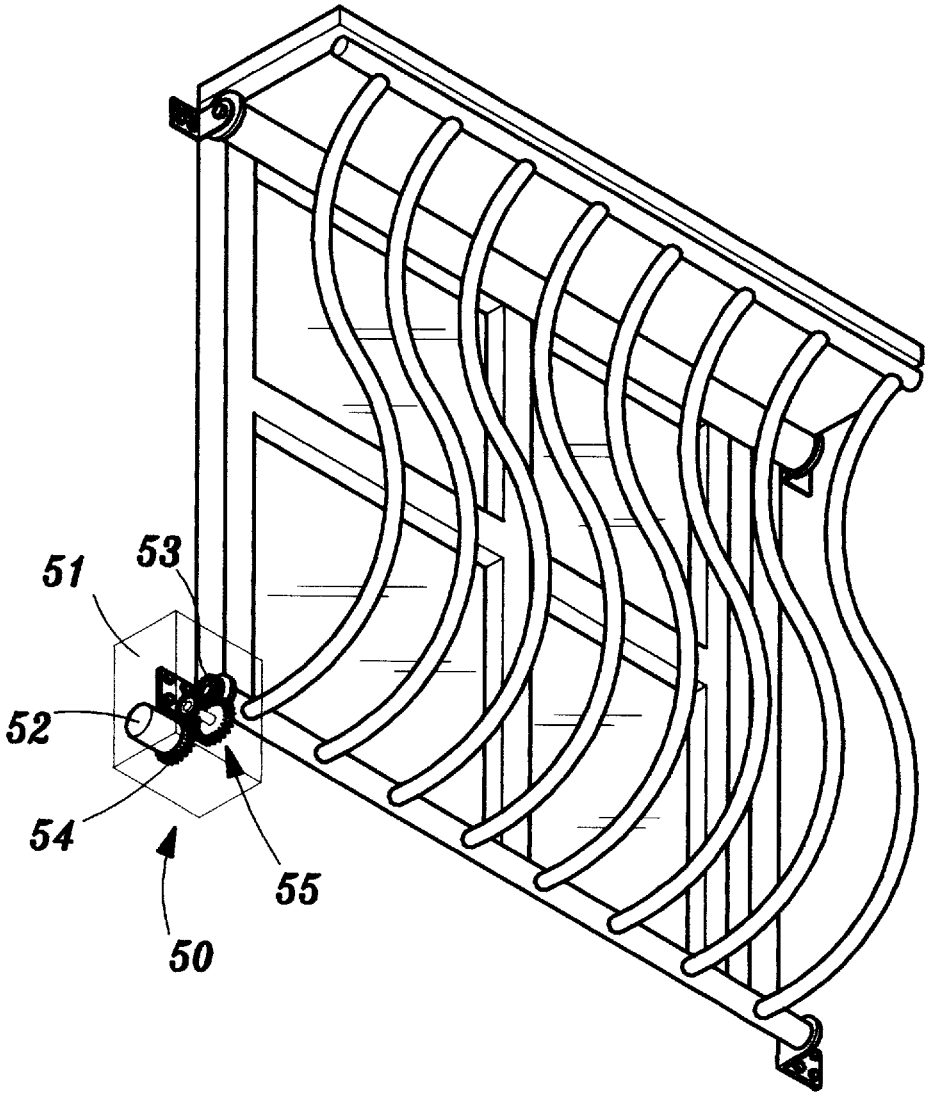
FIG. 4 is a perspective view showing another embodiment of this invention.

The FIG. 4 shows another embodiment of this invention, in this embodiment, we can install a pair of drive devices 50 on two sides of the window-sill 30 for controlling the open angle of the anti-theft window 10. The drive device 50 is composed of a case 51 a drive device motor 52, a driven gear 53 installed on the pivot arm 13, a drive gear 54 installed on shaft of the drive motor 52 and a reduction gear 55 engaged with the drive gear 54 and the driven gear 53 to adjust the rotation speed of the driven gear 53. Accordingly, as we starting the drive motor 51, the drive gear 54 can drive the driven gear 53 installed on the pivot arm 13 so as to make the anti-theft window 10 rotated to open or close, furthermore, the open angle of the anti-theft window can be got precisely by means of the drive device 50. In addition, we can install a sensitometer (not shown in figures) on the drive device 50 for sensing the brilliance of sunlight. If the sunlight is very strong, the sensitometer can start drive device 50 to rotate the anti-theft window 10 and drag the sunshade curtain 23 openly for shading sunlight, on the other hand, if the sunlight is weak, the sensitometer can make drive motor rotate reversibly to draw back the anti-theft window 10 and return the sunshade curtain 23.

It is understood by those skilled in the art that the foregoing description is a preferred embodiment of the disclosed device and that various changes and modifications may be made in the invention without departing from the spirit and scope thereof.

What is claimed is:

1. A sunshade anti-theft window comprising:

an anti-theft window comprised of a plurality of partition rods and having a pivot arm installed at its bottom, said pivot arm being pivoted at the bottom of a window opening;

a rolling curtain installed at the top of said window opening, said rolling curtain comprising a rolling shaft and a sunshade curtain winded on the rolling shaft, said sunshade curtain being connected with the top of said anti-theft window;

said anti-theft window adapted to be rotated around said pivot arm to open in various angels, said sunshade curtain adapted to be dragged open by said anti-theft window for shading sunlight.

2. A sunshade anti-theft window as claimed in claim 1, wherein said rolling curtain has a tension spring installed therein, said tension spring adapted to return said sunshade curtain to an original retracted position as the anti-theft window is moved to a closed position.

3. A sunshade anti-theft window as claimed in claim 1, further including a pair of guide rails installed at opposite sides of said window opening and a pair of control rods, one end of each said control rod being pivoted on a side of said anti-theft window and the other end being installed in a respective guide rail so as to control the open angle of said anti-theft window.

4. A sunshade anti-theft window as claimed in claim 3, wherein each said guide rail includes a guide groove having a plurality of locating holes, one end of each said control rod being inserted into a guide groove and adapted to be slidden freely in said guide groove and located in said locating holes, such that, said anti-theft window can be located at different angles by changing the locating position of said control rods in said locating holes.

* * * * *